US007862315B2

(12) United States Patent
Rohlfing et al.

(10) Patent No.: US 7,862,315 B2
(45) Date of Patent: Jan. 4, 2011

(54) SCREW DISPLACEMENT PUMP

(75) Inventors: Gerhard Rohlfing, Hille (DE); Axel Jaeschke, Minden (DE); Jens-Uwe Brandt, Rintein (DE)

(73) Assignee: Joh.Heinr.Bornemann GmbH, Obernkirchen (DE)

( * ) Notice: Subject to any disclaimer, the term of this patent is extended or adjusted under 35 U.S.C. 154(b) by 505 days.

(21) Appl. No.: 11/916,108

(22) PCT Filed: May 31, 2006

(86) PCT No.: PCT/DE2006/000940

§ 371 (c)(1),
(2), (4) Date: Feb. 27, 2008

(87) PCT Pub. No.: WO2006/128441

PCT Pub. Date: Dec. 7, 2006

(65) Prior Publication Data

US 2008/0199340 A1 Aug. 21, 2008

(30) Foreign Application Priority Data

Jun. 2, 2005 (DE) ..... 10 2005 025 816

(51) Int. Cl.
*F01C 1/16* (2006.01)
*F01C 1/24* (2006.01)
*F03C 2/00* (2006.01)

(52) U.S. Cl. ..... 418/201.1; 418/46; 418/47; 418/96; 418/DIG. 1

(58) Field of Classification Search ..... 418/46, 418/47, 96, 97, 101, 201.1, 206.1, 206.7, 418/206.8, DIG. 1

See application file for complete search history.

(56) References Cited

U.S. PATENT DOCUMENTS

| | | | | |
|---|---|---|---|---|
| 2,381,695 | A | 8/1945 | Sennet | |
| 3,016,842 | A | 1/1962 | Montelius | |
| 4,420,293 | A * | 12/1983 | Hofmann | 418/96 |
| 5,269,667 | A * | 12/1993 | Mauney | 418/201.1 |
| 6,758,660 | B2 * | 7/2004 | Kriehn et al. | 418/201.1 |

FOREIGN PATENT DOCUMENTS

| | | |
|---|---|---|
| DE | 715860 | 3/1942 |
| DE | 3245973 | 12/1982 |

(Continued)

OTHER PUBLICATIONS

International Search Report PCT/ISA/210.

(Continued)

*Primary Examiner*—Theresa Trieu
(74) *Attorney, Agent, or Firm*—Andrew M. Calderon; Roberts Mlotkowski Safran & Cole, P.C.

(57) ABSTRACT

A screw displacement pump is provided. The screw displacement pump is of single-entry, double-shaft construction with an external bearing of the two screw shafts. A pump housing encloses the screw shafts by forming feed chambers and externally delimiting the feed chambers with its internal shell surface, as well as a suction chamber for the medium to be induced and a pressure chamber to accommodate the medium pumped by the screw shafts. The pump housing is inserted into a pressure housing and attached to the pressure housing, so that the pressure chamber encloses the pump, at least in part.

19 Claims, 1 Drawing Sheet

FOREIGN PATENT DOCUMENTS

| | | | | |
|---|---|---|---|---|
| DE | 9315766 | | 10/1993 | |
| DE | 19748385 | | 11/1997 | |
| DE | 10257859 | | 8/2004 | |
| EP | 0405160 | | 5/1990 | |
| EP | 0699276 | | 4/1994 | |
| JP | 59176491 A | * | 10/1984 | ..... 418/96 |
| RU | 2 164 312 | | 3/2001 | |

OTHER PUBLICATIONS

Written Opinion of the International Searching Authority PCT/ISA/237.

* cited by examiner

SCREW DISPLACEMENT PUMP

BACKGROUND SECTION

1. Field of the Invention

The invention relates to a screw displacement pump of single-entry, double-shaft construction with an external bearing of two screw shafts and a pump housing enclosing the screw shafts by forming feed chambers and externally delimiting the feed chambers with its internal shell surface, as well as a suction chamber for the medium to be induced and a pressure chamber to accommodate the medium pumped by the screw shafts.

2. Discussion of Background Information

Many screw displacement pump concepts are known, e.g., a double-shaft, double-entry embodiment according to EP 0 699 276 B1, which is used, in particular, for pumping untreated crude oil/water/gas mixtures exiting from one very large well or from many, in part more than 500, small wells. Double-entry screw pumps have a housing subdivided into a suction chamber and a pressure chamber. The feed screws run either directly in the housing or in an exchangeable housing insert that is inserted into the housing between the suction chamber and the pressure chamber. The housing thereby serves, on the one hand, to provide a sufficient compressive strength to absorb the process pressure and, on the other hand, to provide the shape and positional stiffness to maintain the sealing-gap tolerances required for the pressure-increasing process among the feed screws and between the feed screws and the housing or the housing insert, with the feed screws, running in a non-contact manner, placing particularly high demands on the sealing gaps that are as small as possible, in order to achieve a high efficiency.

Screw displacement pumps embodied in a double-shaft, double-entry manner are technically very complex, cost-intensive in terms of production and servicing and are thus preferably used for larger pump performances that are typically already too large for pumping single wells (single-well boosting).

From DE 715860 B1, a mixed-flow pump for pumped liquids is known that has a single-sided external bearing for the feed screws. The feed screws are enclosed by a housing embodied as one piece and flange-connected to a housing part in which the screw-shaped rotors are supported. This housing can be removed for servicing tasks. If the pump has to be serviced, it is necessary to take the pump out of the feed line at the inlet and outlet pipes and to install a completely new pump.

Alternatively to a complete replacement, a screw displacement pump can be dismantled and repaired on site, which is very time-consuming. Furthermore, a pump assembly from several components at the customer's location has the disadvantage that a pump test with a precise determination of the performance data is impossible, so that as a rule a complete pump replacement is necessary to meet the required performance parameters.

Especially with single-well boosting there are high fluctuations in the composition of the medium to be pumped. States of pumping 100% liquid and phases of pumping 100% gas alternate in a largely unpredictable manner, whereby the phases of pumping 100% gas are particularly critical for screw displacement pumps, since with conventional screw displacement pumps the sealing, cooling and lubricating liquid is removed after a certain time of gas pumping. This causes a heating of the feed screw displacements and, associated therewith, a contact of the feed screws with one another and with the feed housing, which causes a higher wear, and possibly a stoppage of the pump. The problems thus arising in terms of servicing on site have already been described.

In addition to screw displacement pumps, eccentric screw pumps are also used for single-well boosting. The eccentric screw pumps are suitable only to a limited extent for pumping multi-phase mixtures, as their capability of pumping 100% gas is very limited in terms of time because of the friction heat being produced.

As a result of the oversizing of multi-phase pumps in a double-shaft, double-entry embodiment and for lack of suitable multi-phase pumps with lower output, thousands of oil wells all over the world are not or are no longer being worked. This means that valuable raw materials are not being used.

SUMMARY OF THE INVENTION

The present invention provides a pump that can be produced and serviced in a cost-effective manner and is basically suitable for pumping multi-phase mixtures within the scope of single-well boosting.

This is attained according to the invention by a generic screw pump with the features of the independent claims. Advantageous embodiments and further developments of the invention are described in the subordinate claims.

The screw displacement pump according to the invention is a single-entry, double-shaft construction with an external bearing of two screw shafts. A pump housing encloses the screw shafts by forming feed chambers and externally delimiting the feed chambers with its internal shell surface, as well as a suction chamber for the medium to be induced and a pressure chamber to accommodate the medium pumped by the screw shafts. The screw displacement pump in a single-entry, double-shaft construction provides that the pump housing is inserted into a pressure housing and attached to the pressure housing, so that the pressure chamber encloses the pump housing at least in part. Since the pump housing can be inserted into the pressure housing and since the pump housing is attached to the pressure housing, it is possible to exchange merely the pump housing together with the screw shafts arranged therein and with the external bearing. In this way the screw displacement pump is provided in modular construction. Thus, the pump can be repaired quickly because the wearing parts can be removed completely from the pressure housing. A simple exchange of the pump housing with the screw shafts arranged therein furthermore results in a mechanical decoupling of the pressure housing and the pump housing, so that deformations caused by pressure within the pressure housing are not transferred to the pump housing, at all, or are transferred merely to an imperceptible extent. The position accuracy of the screw shafts to one another thus remains ensured, since the deformations of the pressure housing have no effect on the tolerances of the feed elements, seals and bearings. This reduces wear and allows the adjustment of a narrow gap size, which increases the efficiency of the pump.

A further development of the invention provides that the pump housing extends through the pressure housing, so that the pump housing has two mating points or end bearing points in the pressure housing. It is also provided for the pump housing to be attached, in particular screwed, to the pressure housing only on one side, whereas the end of the pump housing not attached to the pressure housing is supported in a guideway in the pressure housing. It is thus rendered possible for the pump housing to be supported in the pressure housing in a fixed manner on one side and in an easily moveable manner on the other side, whereby the slight clearance between the pressure housing and the pump housing is sealed by at least one seal, so that no medium to be pumped can leak from the pressure chamber through gaps in the guideway. The slight clearance within the guideway in the pressure housing ensures that the pressure prevailing in the pressure chamber does not cause any deformations within the pump housing, which might alter the clearance among the screw shafts and between the screw shafts and the pump housing, so that the pump housing as a whole is slightly displaced within the pressure housing.

A further advantage of the embodiment according to the invention is the simpler manufacture of the pressure housing because of the lower demands on the position accuracy of the components. In this way, the pressure housing can be produced in a more cost-effective manner. Furthermore, servicing is considerably simplified because of the complete removability of the pump housing together with the screw shafts and the bearing unit.

In order to achieve the stiffest construction possible despite the simple structure, the pump housing is attached to the pressure housing via a base plate. Both the pressure housing and the pump housing are thus attached to the base plate, and possibly also the bearing unit in which the screw shafts are supported separated from the pumped flow. The screw shafts are supported in the bearing unit, which is in turn connected to the pump housing, so that the bearing unit can be removed completely from the pressure housing together with the pump housing and the screw shafts. The screw shafts, the pump housing and the bearing unit of the screw shafts can thus be combined to form a feed module that can be exchanged easily and subjected to a complete performance test after manufacture. It is thus possible to predict the performance parameters of the pump when the feed module is exchanged for a new or overhauled feed module.

With a use in single-well boosting it is provided for reasons of compression to provide separation devices in the pressure chamber to separate a pumped multi-phase mixture into a gas phase and a liquid phase, so that either the separated phases can be discharged separately or a part of the separated liquid phase can be guided back from the pressure chamber to the suction chamber via a short-circuited line, in order to provide a minimum amount of liquid within the pump housing. In this way the screw shafts can be cooled and the gap between the screw shafts and between the screw shafts and the pump housing can be sealed. Since the pump housing is located within the pressure housing, it is possible to embody the short-circuited line within the pump housing, thus producing a direct connection between the pump chamber and the suction chamber.

The short-circuited line guides separated liquid phase back into the suction chamber in a metered manner, which entails losses in the efficiency of the pump, but renders possible a greatly extended service life when the screw displacement pump is used to pump multi-phase mixtures.

The pump housing can be arranged off-center in the pressure housing in order to facilitate the separation and the return of the separated liquid phase to the suction side of the screw shafts through a short-circuited line and to prevent an effect of the pressure-dependent deformations of the pressure housing on the bearing unit or on the screw shafts, or to cause this effect to produce an angular deformation of the bearing unit that counteracts a pressure-dependent deflection of the screw shafts.

In addition, tie rods can be arranged in the pressure housing to prestress the pressure housing with respect to the screw shaft bearing, so that a pressure-dependent angular deformation of the bearing unit can be adjusted alternatively or in addition to a suitable positioning of the pump housing in the pressure housing and to the selection of the wall thickness and/or the use of materials.

In a further integration of functions into the feed module, the suction chamber is embodied in the pump housing, so that the suction chamber can be optimally adapted to the feed screws in terms of sizing and flow technology design.

In order to simplify the embodiment of the pressure housing, the pump housing forms a part of the wall of the pressure chamber, i.e., for the insert of the pump housing to form a part of the interior wall of the pressure chamber. This requires the pump housing to be attached to the pressure housing in a sealed manner, whereby passages or flow channels for the pumped medium are provided, through which the pumped medium is guided into the pressure chamber.

Connecting devices for supply lines or discharge lines are also embodied on the pressure housing, so that the pressure housing does not have to be removed from the line network when the pump is serviced. This makes it possible to prevent a considerable assembly expenditure and to avoid seal-tightness problems from installing complete pumps in or removing them from the line network.

BRIEF DESCRIPTION OF THE DRAWINGS

An exemplary embodiment of the invention is explained below on the basis of the single FIG. 1 representing a screw displacement pump in cross-sectional view.

DETAILED DESCRIPTION OF THE PRESENT INVENTION

Figure 1:
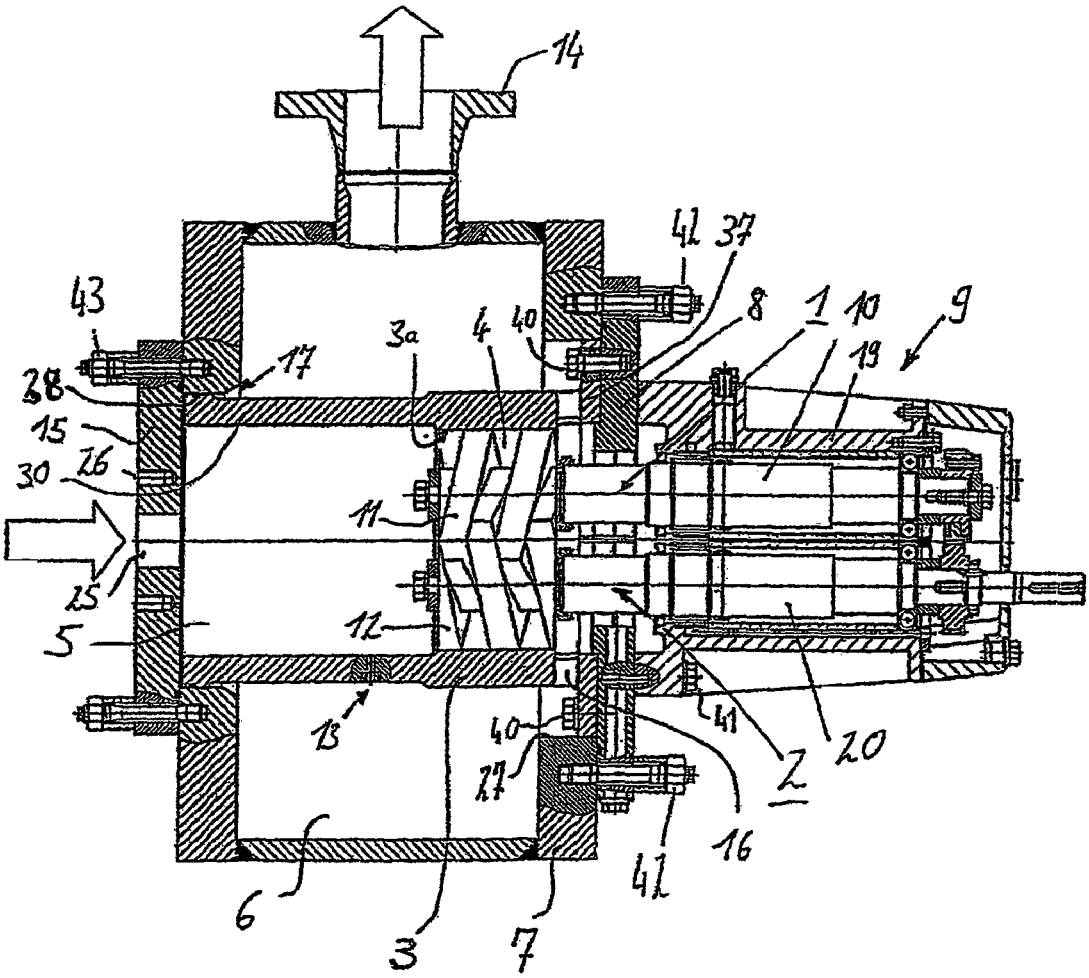

FIG. 1 shows a single-entry screw displacement pump with two screw shafts 1, 2, which are composed of shafts 10, 20 coupled to one another by means of gear wheels, and rotors 11, 12 attached thereto via screws. The shafts 10, 20 are supported in a bearing housing 19 and form a bearing unit 9 sealed with respect to the medium to be pumped. The rotors 11, 12 are supported in a pump housing 3, with the shell inner surface 3*a* of the pump housing 3 enclosing the rotors 11, 12, so that feed chambers 4 are formed through the rotors 11, 12 meshing with one another in conjunction with the shell surface 3*a*, in which feed chambers the medium to be pumped is pumped via connecting channels 16 from a suction chamber 5 into a pressure chamber 6. There is a minimum clearance between the rotors 11, 12 as well as between the rotors 11, 12 and the shell surface 3*a*, in order to keep the leak rate of the pump to a minimum.

The pressure chamber 6, embodied as an annular space, is formed by a pressure housing 7 that delimits the pressure chamber 6 respectively on the face side on the exterior circumference. The inner delimitation of the pressure chamber 6 is realized via the exterior wall of the pump housing 3, since the pump housing 3 extends through the pressure housing 7 and thus through the pressure chamber 6. The pump housing 3 is attached to a base plate 8 by means of studs 40. The bearing unit 9 is also attached to the base plate 8 by studs 41. The base plate 8 is in turn coupled to the pressure housing 7 via tie rods 42, so that the pump housing 3 is attached on one side to the pump housing 7 via the studs 40, the base plate 8 and the tie rods 42. In the area of the studs 40, the pump housing 3 is provided with an annular flange 37 that can be inserted into a correspondingly embodied recess 27 of the pump housing 7. The end 30 of the pump housing 3 facing away from the base plate 8 is supported in a recess 17 of the pump housing 7; it is not screw-connected there, however, but only sealed via a seal 38. On the face side, a further seal is sealed via the faceplate 15 that has a through hole 25 to introduce the pumped medium into the suction chamber 5. Screw threads 26 are also provided to receive connecting means or supply lines in the faceplate 15. The face plate 15 is coupled to the pressure housing 7 via tie rods 43.

The one-sided support of the pump housing 3 on the pressure housing 7 has the advantage that the combination, structured in a modular manner, of pump housing 3, bearing unit 9 and the feed screws 1, 2 arranged therein is decoupled from the compression strains of the pressure housing 7. The pressure housing 7 can be designed for the respective system design pressure and can basically be embodied as large as desired, whereby merely the recesses 17, 27 and the connecting devices must be embodied such that the respective feed units or feed modules composed of pump housing 3 and bearing unit 9 can be mounted. The pump is completed by inserting the feed unit into the pressure housing 7, with the pump housing 3 integrated into the feed unit simultaneously forming the suction chamber 5 and ensuring the separation of suction chamber 5 from pressure chamber 6.

Furthermore, flanges 14 are provided on the pressure housing 7 for the discharge lines, which can remain installed in a fixed manner.

Separation devices can be provided in the pressure chamber 6 for the separation of gas phase and liquid phase when multi-phase mixtures are pumped. These devices can be baffle plates or settling zones for producing a flow speed close to zero, with a short-circuited line 13, connecting the suction chamber 5 to the pressure chamber 6, preferentially being provided at points of this type. In the embodiment shown, the short-circuited line 13 is embodied in the pump housing 3 and arranged on the bottom side, so that liquid located in the lower part of the annular pressure chamber 6, which liquid is filled up to the pressure housing 3, can be induced into the suction chamber 5 and moved through the rotors 11, 12. This causes a heat transfer, a sealing and a lubrication of the rotors 11, 12. The embodiment shown is suitable in particular to ensure a safe functioning of the pump even with very different wellhead pressures, which can rise from quasi atmospheric pressures to over 100 bar.

Pump protection filters can be integrated or arranged in the inlet opening 25 or before it, in order to hold back undesired particles and to prevent damage to the rotors 11, 12.

The invention claimed is:

1. A screw pump of single-entry, double-shaft construction, comprising:

screw shafts;

a pump housing enclosing the screw shafts by forming feed chambers and externally delimiting the feed chambers with its internal shell surface, and an suction chamber for medium to be induced and a pressure chamber to accommodate the medium pumped by the screw shafts; and the pump housing being inserted into a pressure housing and attached to the pressure housing, so that the pressure chamber encloses the pump housing at least in part, wherein the screw shafts are supported with an external bearing, separation devices are provided in the pressure chamber to separate a pumped multi-phase mixture into a gas phase and a liquid phase, and a short-circuited line is provided from the pressure chamber to the suction chamber, through which separated liquid is guided back into the suction chamber.

2. The screw pump according to claim 1, wherein the pump housing extends through the pressure housing.

3. The screw pump according to claim 1, wherein the pump housing is attached to the pressure housing on one side.

4. The screw pump according to claim 3, wherein the pump housing is attached to the pressure housing via a base plate.

5. The screw pump according to claim 3, wherein:

an end of the pump housing not attached to the pressure housing is supported with clearance in a guideway in the pressure housing, and the pump housing is sealed with respect to the pressure housing by a seal.

6. The screw pump according to claim 3, wherein the screw shafts are supported in a bearing unit connected to the pump housing.

7. The screw pump according to claim 6, wherein the bearing unit is attached to a base plate.

8. The screw pump according to claim 7, wherein the bearing unit is screwed to the base plate.

9. The screw pump according to claim 1, wherein the screw shafts, the pump housing and a bearing unit of the screw shafts are combined to fowl a feed module.

10. The screw pump according to claim 1, wherein the short-circuited line is embodied in the pump housing.

11. The screw pump according to claim 1, wherein the pump housing is arranged off-center in the pressure housing.

12. The screw pump according to claim 1, further comprising tie rods arranged in the pressure housing to pre-stress the pressure housing with respect to a screw shaft bearing.

13. The screw pump according to claim 1, wherein the suction chamber is embodied in the pump housing.

14. The screw pump according to claim 1, wherein the pump housing forms a part of a wall of the pressure chamber.

15. The screw pump according to claim 1, further comprising connecting devices for feed lines and discharge lines embodied on the pressure housing.

16. The screw pump according to claim 1, wherein the pump housing is screwed to the pressure housing on one side.

17. A screw pump of single-entry, double-shaft construction, comprising:

screw shafts with external bearings;

a pressure housing forming a pressure chamber;

a pump housing enclosing the screw shafts and inserted into the pressure housing such that the pressure chamber encloses the pump housing at least in part, the pump housing being attached to the pressure housing by a base plate, wherein the pump housing together with the two screw shafts arranged therein and the external bearings are modular and are removable from the pressure housing, and a short-circuited line is provided from the pressure chamber to a suction chamber, through which separated liquid is guided back into the suction chamber.

18. The screw pump according to claim 17, wherein the pump housing and a bearing unit for the external bearings is attached to the base plate by studs and the base plate is coupled to the pressure housing via tie rods such that that the pump housing is attached on one side to the pump housing via the studs, the base plate and the tie rods.

19. The screw pump according to claim 18, wherein the pump housing is provided with an annular flange that is insertable into a correspondingly embodied recess of the pump housing and an end of the pump housing facing away from the base plate is supported in a recess and sealed via a seal.

* * * * *